United States Patent [19]

Bertrand

[11] Patent Number: 4,538,979

[45] Date of Patent: Sep. 3, 1985

[54] METHOD OF CONTROLLING A COMBUSTION FLAME

[75] Inventor: Claude Bertrand, Orleans, France

[73] Assignee: Centre National de la Recherche Scientifique (CNRS), Paris, France

[21] Appl. No.: 587,880

[22] Filed: Mar. 15, 1984

Related U.S. Application Data

[63] Continuation of Ser. No. 304,639, Sep. 22, 1981, abandoned.

[30] Foreign Application Priority Data

Sep. 25, 1980 [FR] France ..... 80 20591

[51] Int. Cl.[3] ..... F23N 1/00

[52] U.S. Cl. ..... 431/12; 431/75

[58] Field of Search ..... 431/12, 2, 6, 13, 75; 236/1 A

[56] References Cited

U.S. PATENT DOCUMENTS 2,767,783 10/1956 Rowell et al. ..... 431/12
2,966,209 12/1960 Pegrum ..... 431/186 X
3,811,816 5/1974 Whitman .

FOREIGN PATENT DOCUMENTS 2042221A 9/1980 United Kingdom .

*Primary Examiner*—Randall L. Green
*Attorney, Agent, or Firm*—Robbins & Laramie

[57] ABSTRACT

This invention relates to combustion control. It preferably uses a microphonic probe. Within a water circulation enclosure, a probe head defines a thin channel joining a cavity to a furnace, the cavity being closed by a diaphragm arranged as an acoustic transducer. The acoustic pressure which is detected is connected to the combustion characteristics. The invention is used in particular for turbulent premixture flames.

5 Claims, 2 Drawing Figures

METHOD OF CONTROLLING A COMBUSTION FLAME

This application is a continuation, of application Ser. No. 304,639, filed Sept. 22, 1981 now abandoned.

BACKGROUND OF THE INVENTION

This invention relates to turbulent combustion and more particularly, but not exclusively, to turbulent premixture flames.

At present, optimum combustion output and minimum pollution caused by the products of combustion are simultaneously being sought. However, the means of control which are presently known for this purpose, for example, thermocouple or optical pyrometers, are not very satisfactory.

BRIEF SUMMARY OF THE INVENTION

The present invention substantially improves the situation using simple and efficient means.

For this purpose, a method of controlling a turbulent flame is provided, according to which the acoustic noise level generated by a flame is detected, a pilot signal connected to the acoustic noise level which has been detected is produced, and the combustion conditions are adjusted in order to substantially maintain the pilot signal at an extremum. This adjustment may notably have a bearing on the proportion of fuel or on the proportion of the supporter of combustion.

In the case of a premixture flame having a constant flow rate, it has been observed that by using a pilot signal which is defined only from the noise level which has been detected, a mixture concentration of approximately 0.9 is easily maintained, for which the acoustic pressure which has been detected passes through a maximum.

In one embodiment, the pilot signal may be defined as the ratio of the noise level detected to the flow rate of one of the flame components upstream of combustion. By relating the noise level to the fuel flow rate, the maximum is displaced towards lean mixtures.

The acoustic noise level is detected on a predetermined frequency band, selected as a function of the components upstream of the flame. In most cases, this frequency band is located below approximately 3 000 Hz. The frequency band may have a width of a few hundred Hertz or, in one embodiment it may extend from zero to a cut-off frequency lower than 3 000 Hz.

The present invention applies in particular to turbulent combustion, and notably to turbulent premixture flames with gaseous or liquid fuels based on hydrocarbons.

In this respect, the present invention proposes a microphonic probe which comprises:

an enclosure, advantageously for the circulation of cooling fluid, at one end of this enclosure, a probe head defining a thin, narrow channel;

inside the head, a cavity which is closed by a microphone diaphragm; and an acoustic transducer assembly co-operating with the said diaphragm.

The channel is preferably substantially rectilinear. The channel, the cavity and the diaphragm are advantageously arranged in the form of a damped Helmholtz resonator.

In one embodiment, an acoustically damping material is positioned in the cavity opposite the diaphragm.

According to a particular embodiment, the acoustic transducer is arranged as a condenser microphone with a preamplifier.

For its part, the enclosure for the circulation of fluid includes an external part which is generally cylindrical surrounding the assembly, including the probe head, and an internal part having a separate circulation and surrounding the cavity and acoustic transducer assembly.

Other characteristics and advantages of the present invention will be revealed from reading the detailed description which follows. The description refers to the accompanying drawings.

DETAILED DESCRIPTION

Figure 1:
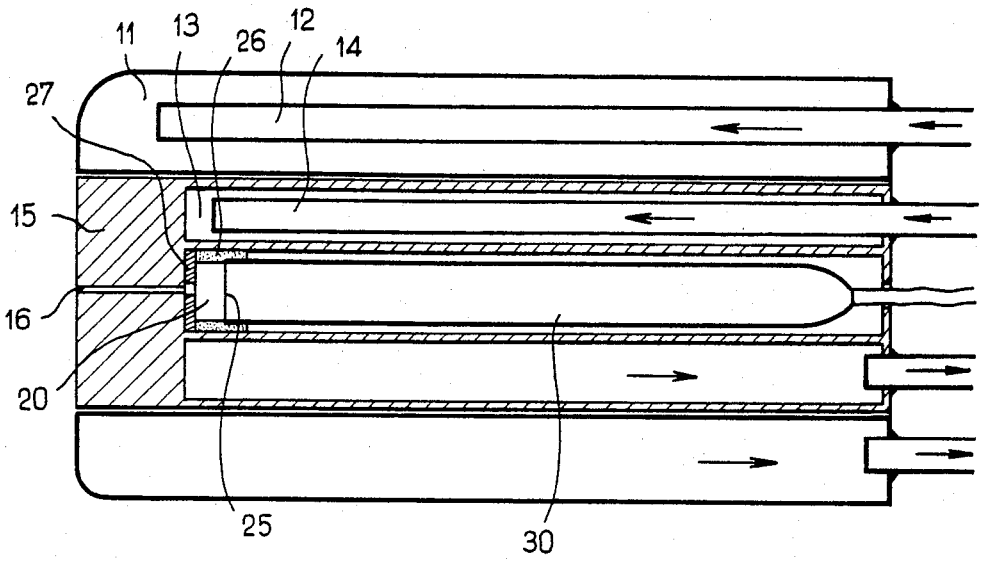
FIG. 1 is a schematic sectional view of a microphonic probe according to the present invention.

Frequency analysis tests have been carried out for turbulent premixture flames of $CH_4$—$O_2$—$N_2$ and $H_2$—$O_2$—$N_2$. In both cases, the combustion noise appears at a constant total flow rate as a continuous spectrum passing through a maximum for frequencies of the order of respectively 350 and 750 Hz. In the first case, the frequency interval at half level is approximately 550 Hz; in the second case, it is approximately 650 Hz.

Moreover, the composition of premixed flames of $CH_4$—$O_2$—$N_2$ was varied while retaining as parameters the concentration r of the flame, the dilution a thereof with nitrogen and the average velocity of the gases at the outlet of the burner, denoted as u. More precisely, r and a are defined as follows:

$$r = \frac{\left[\frac{(CH_4)}{(O_2)}\right]_{\text{actual}}}{\left[\frac{(CH_4)}{(O_2)}\right]_{\text{stoichiometric}}}$$

with $$\left[\frac{(CH_4)}{(O_2)}\right]_{\text{stoichiometric}} = 0.5$$

$$a = \frac{(N_2)}{(N_2) + (CH_4) + (O_2)}$$

For different dilutions with nitrogen, the acoustic pressure which is measured passes through a net maximum around the concentration of 0.9; in the case of a methane flame burning with air at a constant flow rate, this corresponds to an excess of air of approximately 10% in volume. An adjustment of the flame corresponding to the acoustic pressure maximum would thus be an optimum adjustment for industrial burners; a good thermal output is allowed, while avoiding the risks of imperfect and polluting combustion. The "pilot signal", the extremum of which is used to adjust the combustion conditions is then purely and simply the noise level which is detected. The fuel flow rate is adjusted so that the pilot signal remains in the vicinity of its maximum.

In one embodiment, different adjustments are obtained by using the ratio of the acoustic pressure signal to a signal which is, for example, proportional to the fuel flow rate. In this case, the position of the maximum is displaced towards lean mixtures (r=from 0.8 to 0.9), the maximum remaining well marked.

Other tests have shown that industrial burners burning gas or fuel oil behave in a similar manner.

The preliminary experiments described above have been carried out using a constant total flow rate. In practice, in industrial uses, the total flow varies, since it is substantially the fuel flow rate which is acted on, the other flow rates (air or another mixture, oxygen plus nitrogen, for example) remaining substantially constant. Experiments have been carried out at a variable total flow rate using a turbulent premixed flame of $CH_4$—$O_2N_2$. The acoustic pressure signal was the subject of a filtering eliminating the low frequencies. It then appeared that the combustion noise maximum is obtained for a total composition of gases which is very close to stoichiometry (r=1 instead of r=0.9 as before).

By taking the ratio of the acoustic pressure signal to a signal representing the flow note of methane ($CH_4$) as the pilot signal, the maximum of the pilot signal may be restored to the vicinity of the concentration r=0.9 (optimum adjusting conditions with a slight excess of air, for a good combustion output with minimum pollution).

Thus, it appears that the above-described method is flexible enough to be adapted to the actual operating conditions of industrial burners.

The present invention most particularly provides a microphonic probe which is to be introduced into a combustion chamber.

As illustrated in FIG. 1, in the form of a diagram showing the principle of operation, this probe first and foremost comprises an enclosure, preferably with the circulation of cooling fluid, produced in two parts. The external part is composed of, for example, an annular cylindrical cavity 11; a small tube 12 brings water inside the cavity, as close as possible to the left-hand edge which is exposed to the heat. The internal part also comprises an annular cylindrical cavity 13, into which a small admission tube 14 penetrates deeply, and the cavity 13 preferably ensures a separate cooling. The internal part does not extend right up to the end of the external part of the enclosure, in order to leave room to house a probe head 15, pierced by a thin narrow channel, denoted by reference number 16. The channels of the internal part may be produced from a single block with the probe head. The material of the probe head is advantageously conductive, for example, copper. Finally, a place is left on the axis inside the enclosure. This place initially defines a cavity 20, communicating with the channel 16 and closed opposite said channel 16 by means of a sensitive diaphragm 25. A cylindrical ring 26 may be used in order to hold the diaphragm 25 while effectively closing the cavity. The assembly of channel and cavity forms a damped acoustic Helmholtz resonator. A greater damping effect is obtained by positioning in the cavity, opposite the diaphragm 25, a rubber ring 27 which is pierced at the right-hand end of the channel 16.

The sensitive diaphragm 25 is part of an acoustoelectric transducer assembly 30. The membrane 25 is advantageously of the condenser microphone type, followed by a preamplifier.

In practice, the cap of a commercial condenser microphone may simply be replaced by the copper-threaded ring 26, which ensures a good positioning of the sensitive diaphragm.

In practice, the probe head 15 is positioned so that it is just level with the external left-hand edge of the enclosure delimited by the external cylindrical part 11. In this manner, a good cooling of the head is ensured. The internal part 13 ensures a complementary cooling, if necessary, for the microphone and for the preamplifier thereof.

In this respect, it is often preferred to cool the internal part with water at from 50° to 60° C., in order to avoid water vapor condensation on the external face of the probe head 15. It is more important to take care that the cooling circuit is free from air bubbles in order to avoid interference at least in the internal part 13 of the cooling circuit.

Moreover, it has been found that the thin channel 16, which is rectilinear in this case, ensures that the diaphragm 25 is well protected against the radiant heat of the combustion chamber walls. If necessary, the channel 16 could be shaped differently.

The resonance frequency particularly depends on the channel 16 (section and volume) as well as on the volume of the cavity 20. These parameters may be adjusted to obtain the desired resonance frequency, by providing the channel 16 with as short length as possible.

Figure 2:
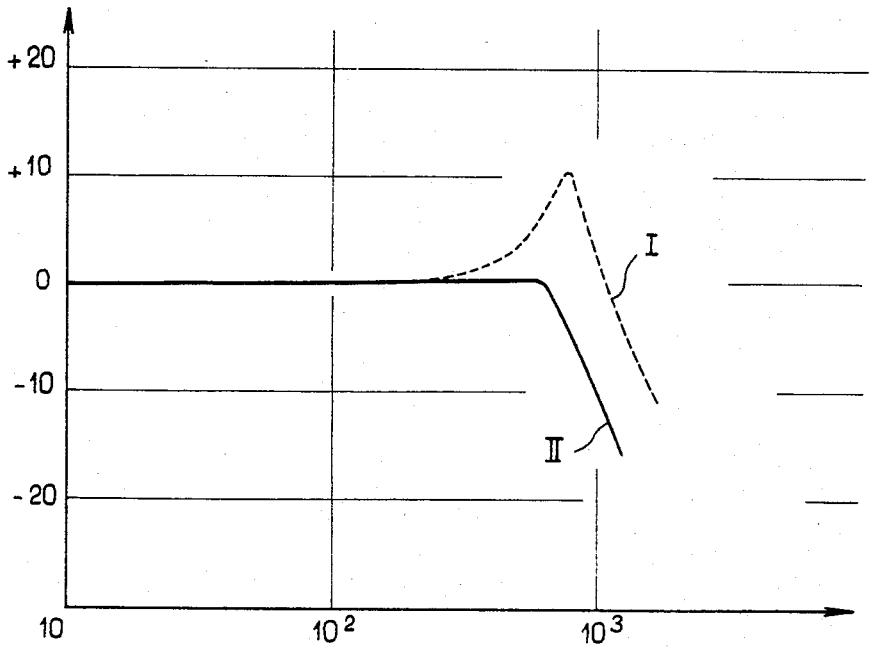
FIG. 2 is a graph illustrating two response curves of the probe.

The curves I and II of FIG. 2 illustrate the response curve of the microphone, respectively without and with the damping ring 27. In the first case, a considerable gain is obtained in the vicinity of the resonance frequency (approximately from 7 to 800 Hz). In the second case, a low-pass liner response is obtained up to a cut-off frequency (approximately 650 Hz), close to the resonance frequency, the cut-off then taking place very abruptly.

The microphonic probe which has been proposed is thus very suitable particularly for the detection of combustion noise, and for combustion regulation according to the method described above. Depending on the use, either the slightly damped probe (curve I, FIG. 2) will be used or the low-pass probe without amplification (curve II, FIG. 2).

A complementary high-pass frequency filtering is preferably added thereto at the output of the preamplifier. In fact, the Applicant considers that it is preferable at present for the frequency band which is used for regulation to be cut off on the low frequency side, below a threshold fixed at a few hundred Hertz (from 100 to 300 Hz for most uses).

Regulation around the maximum of the pilot signal may be effected, for example, as follows: two previous values of the pilot signal are memorized, as well as the variations in the fuel flow rate which were made between these two previous instants and right up to the present value of the pilot signal. It may then be seen if the pilot signal tends towards a maximum and a decision may be made as to the direction of the new variation of the fuel flow rate.

Of course, the present invention is not restricted to the embodiment described, and it extends to any variation which conforms to its spirit. Tranducers other than the condenser type may notably be used, and the preamplifier incorporated in the probe may then possibly be dispensed with. Transducers of an energy form other than electrical may also be considered. The cooling may then be simplified, even omitted.

What we claim is:

1. A method of optimally controlling the combustion of a mixture of pressurized components which provides a turbulent flame substantially exclusively by the acoustic noise level of the flame, comprising the steps of detecting the noise level across a frequency band between approximately 350 to 700 Hertz, converting said noise level to an acoustic pressure signal, generating a control signal representing the flow rate of one of said components, taking the ratio of said acoustic pressure signal to said control signal, using said ratio as a pilot signal, and adjusting the flow rate of one of said components to a level that adjusts the pilot signal to a maximum predetermined amplitude.

2. A method according to claim 1, wherein said mixture is a premixture.

3. The method of claim 1, further including the step of filtering out sound frequencies of 100 Hertz or lower before converting said noise level to said acoustic pressure signal to insure that only the acoustic noise level generated by the flame itself controls the flow rate of said component.

4. The method of claim 1, wherein said adjusted component is methane gas.

5. The method of claim 1, wherein said adjusted component is hydrogen gas.

* * * * *